US009278037B1

(12) United States Patent
Primus

(10) Patent No.: US 9,278,037 B1
(45) Date of Patent: Mar. 8, 2016

(54) TOILET-RAISING PLATFORM

(71) Applicant: Leary Primus, Brockton, MA (US)

(72) Inventor: Leary Primus, Brockton, MA (US)

( * ) Notice: Subject to any disclaimer, the term of this patent is extended or adjusted under 35 U.S.C. 154(b) by 185 days.

(21) Appl. No.: 14/171,872

(22) Filed: Feb. 4, 2014

(51) Int. Cl.
*E03D 11/00* (2006.01)
*A61G 5/14* (2006.01)
*E03D 11/16* (2006.01)

(52) U.S. Cl.
CPC . *A61G 5/14* (2013.01); *E03D 11/16* (2013.01)

(58) Field of Classification Search
CPC ..... A61G 5/14; E03D 11/16
USPC ..... 4/667, 252.1, 252.4, 252.5
See application file for complete search history.

(56) References Cited

U.S. PATENT DOCUMENTS 5,199,113 A * 4/1993 Glasow ..... E03C 1/324 192/129 R
6,553,582 B1 4/2003 Clark
6,745,417 B2 6/2004 Sumino
8,196,233 B1 6/2012 Daniels
8,272,081 B2 9/2012 Anderson, Jr.
8,336,130 B1 12/2012 Cardenas
2010/0050328 A1 3/2010 Hennington

FOREIGN PATENT DOCUMENTS

WO WO 2007133664 12/2008

* cited by examiner

*Primary Examiner* — Tuan N Nguyen

(57) ABSTRACT

The toilet-raising platform includes a platform that is configured to attach to a base of a toilet, and said platform being capable of raising and lowering the toilet as needed. The platform is constructed of a gasket that is sandwiched in between a toilet base and a plate member. The plate member includes a first waste pipe that extends downwardly, and is in fluid communication with the toilet base. The first waste pipe extends downwardly through an access plate that is positioned beneath the toilet. The access plate covers a cavity that is integrated into the floor structure beneath the toilet. The cavity includes a lifting system that works to raise and lower the first waste pipe along with the plate member and toilet.

6 Claims, 5 Drawing Sheets

TOILET-RAISING PLATFORM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilets, more specifically, a platform that enables a toilet to be raised and lowered as needed.

SUMMARY OF THE INVENTION

An embodiment of the disclosure meets the needs presented above by generally comprising a platform that is configured to attach to a base of a toilet, and said platform being capable of raising and lowering the toilet as needed. The platform is constructed of a gasket that is sandwiched in between a toilet base and a plate member. The plate member includes a first waste pipe that extends downwardly, and is in fluid communication with the toilet base. The first waste pipe extends downwardly through an access plate that is positioned beneath the toilet. The access plate covers a cavity that is integrated into the floor system that works to raise and lower the first waste pipe along with the plate member and toilet. The first waste pipe is configured to attach to an existing house waste pipe. Moreover, the existing house waste pipe is rigidly seated inside of the cavity. The first waste pipe is able to maintain a watertight connection with the existing house waste pipe.

These together with additional objects, features and advantages of the toilet-raising platform will be readily apparent to those of ordinary skill in the art upon reading the following detailed description of presently preferred, but nonetheless illustrative, embodiments of the toilet-raising platform when taken in conjunction with the accompanying drawings.

In this respect, before explaining the current embodiments of the toilet-raising platform in detail, it is to be understood that the toilet-raising platform is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toilet-raising platform.

It is therefore important that the claims be regarded as including such equivalent construction insofar as they do not depart from the spirit and scope of the toilet-raising platform. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
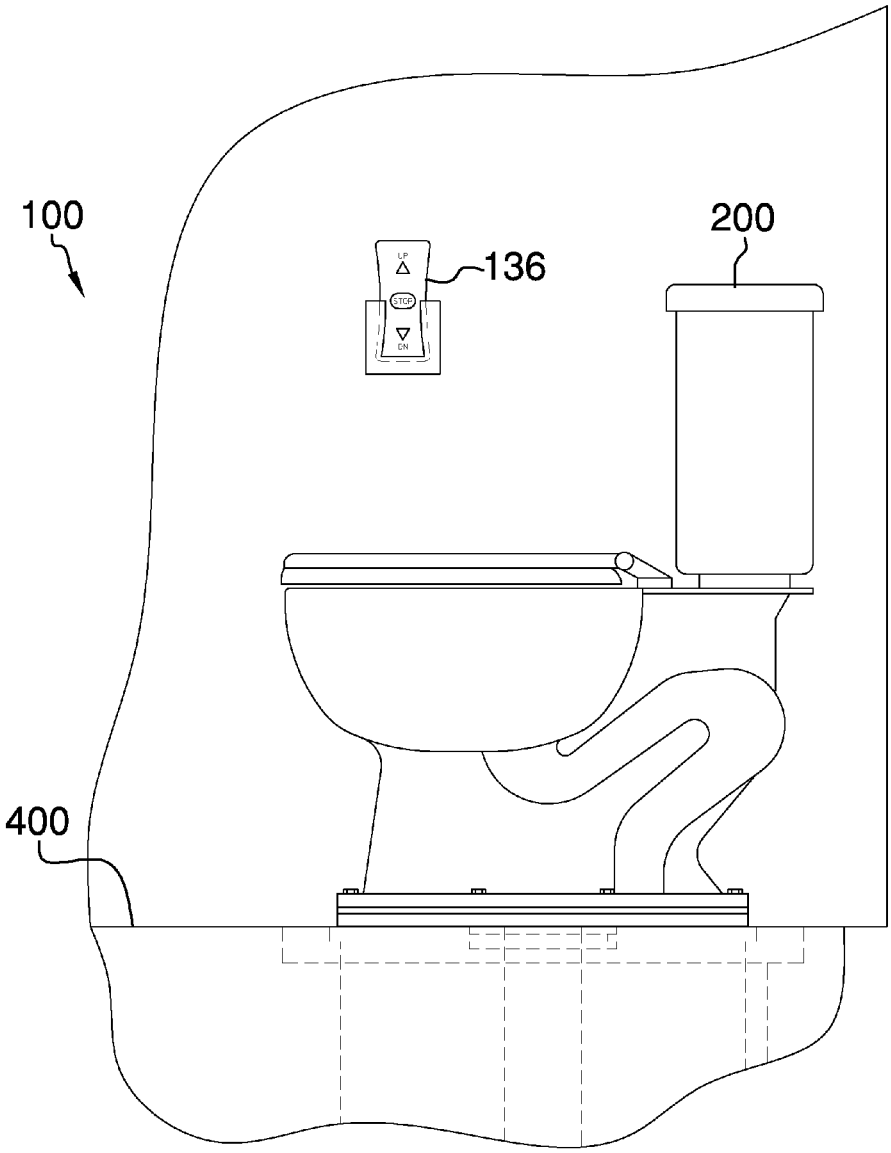
FIG. 1 is a side view of a toilet and the toilet-raising platform.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the toilet-raising platform 100 (hereinafter invention) generally comprises a platform 101 consisting of a gasket 102, a plate member 103, and a first waste pipe 104. The platform 101 is responsible for raising and lowering a toilet 200. Moreover, the platform 101 is configured to attach to a toilet base 201 of the toilet 200. The gasket 102 is positioned in between a bottom toilet base surface 202 of the toilet base 201, and a top plate member surface 105 of the plate member 103.

The plate member 103 is rigidly affixed atop of the first waste pipe 104. The first waste pipe 104 and the plate member 103 have an opening 106 that aligns with a gasket hole 107 and a toilet base hole 203. Moreover, the opening 106, the gasket hole 107, and the toilet base hole 203 align to form a watertight seal, which enables debris to exit the toilet 200, and down through the platform 101.

Figure 2:
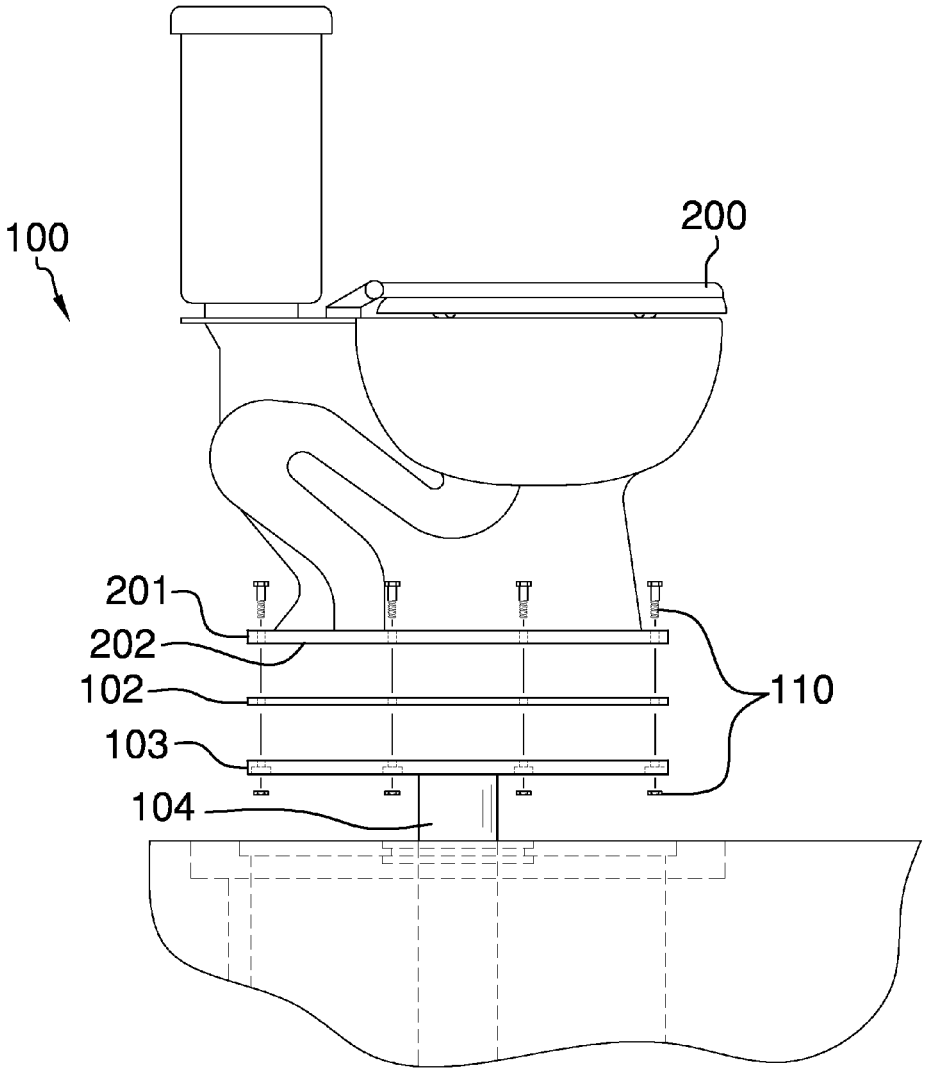
FIG. 2 is a side, exploded view of a toilet base and the toilet-raising platform.
Figure 3:
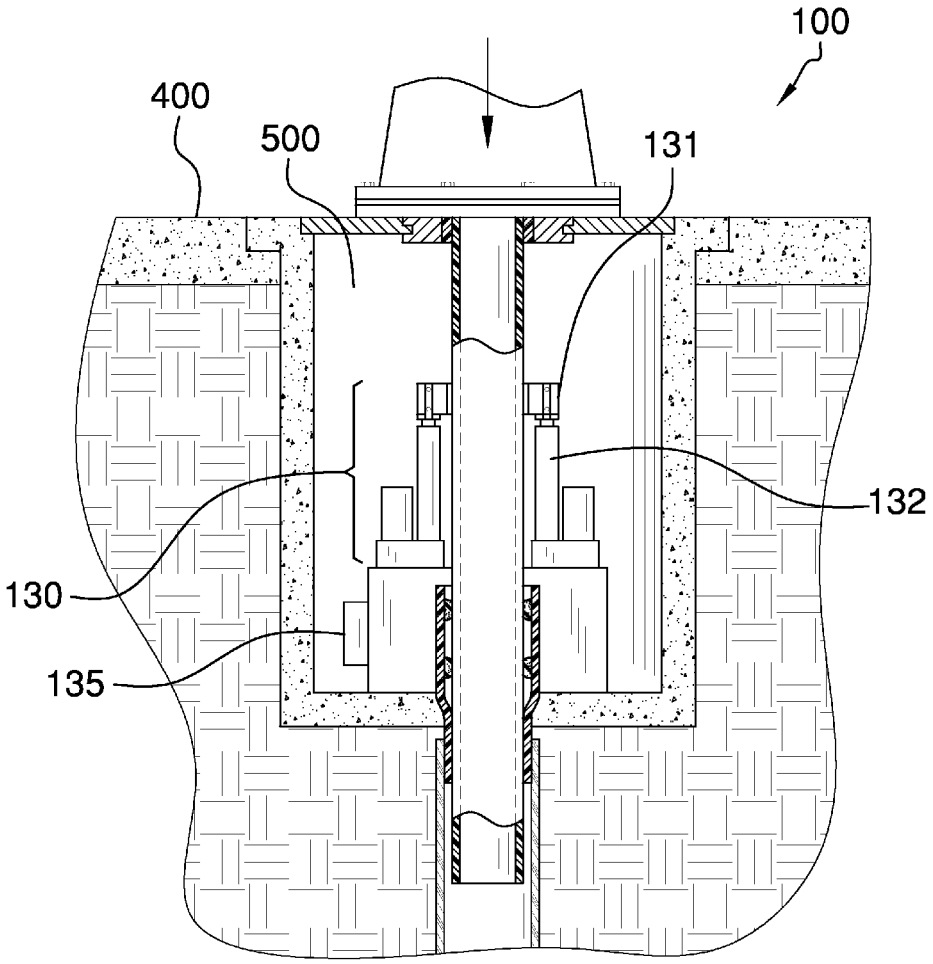
FIG. 3 is a detail view of the cavity with the toilet in a lowered orientation.
Figure 4:
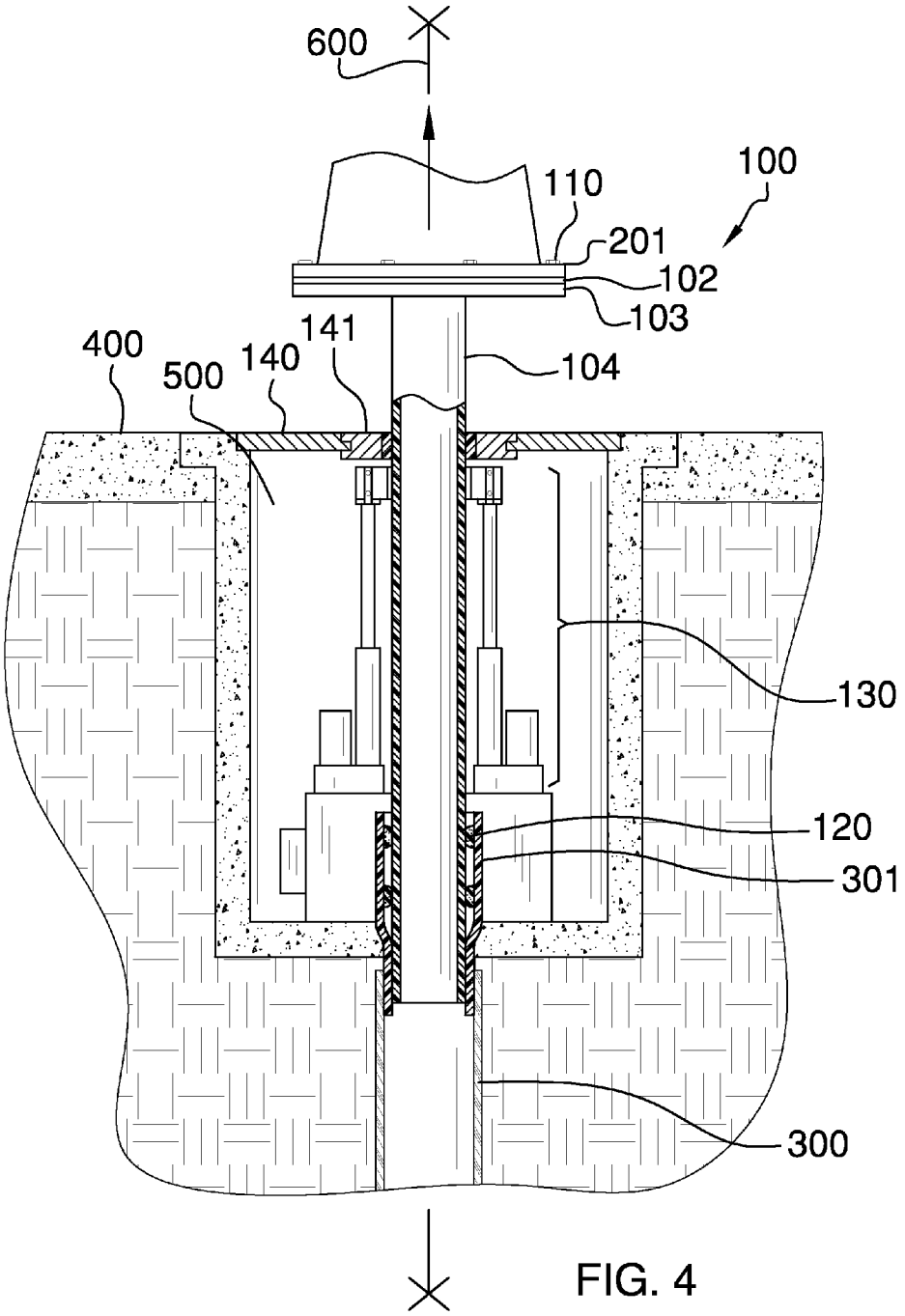
FIG. 4 is a detail view of the cavity with the toilet in a raised orientation.
Figure 5:
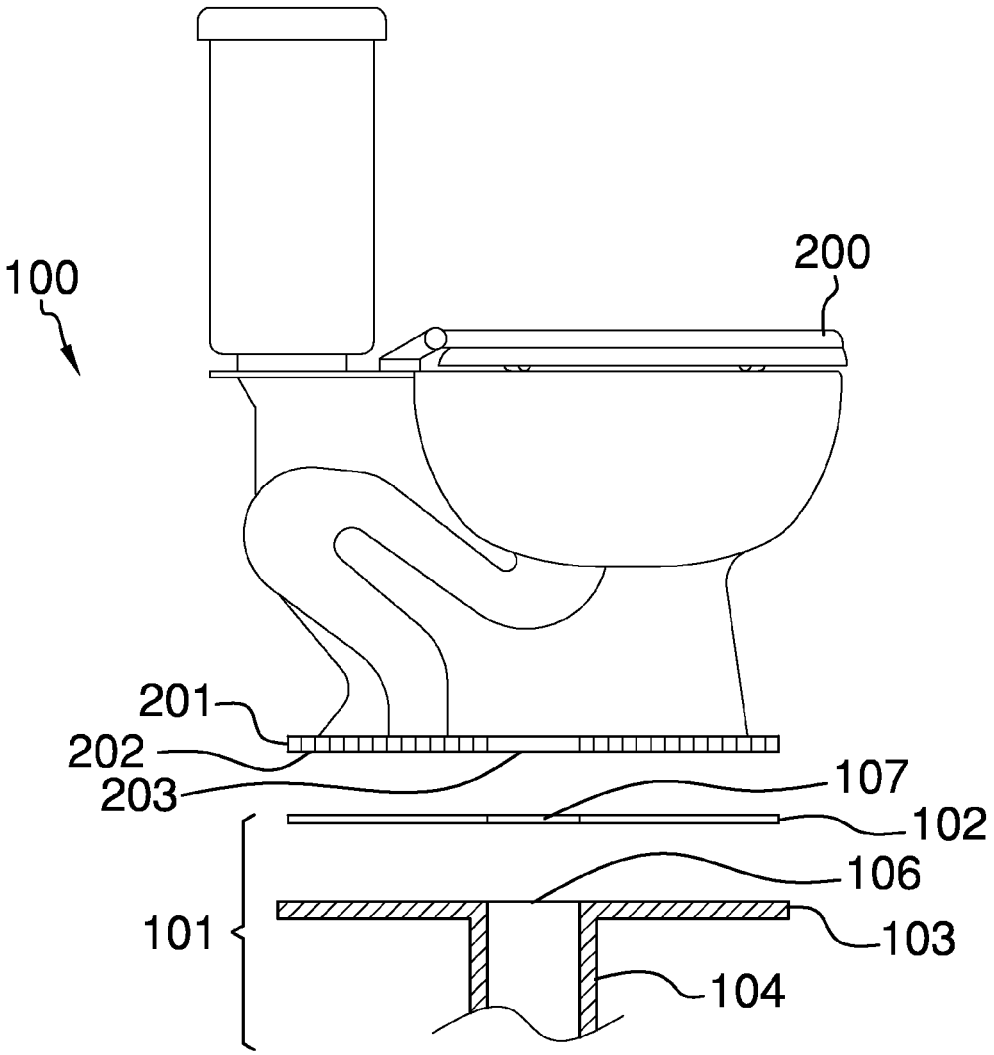
FIG. 5 is another exploded view detailing a cross-section of the toilet base and platform.

Referring to FIG. 2, a plurality of fasteners 110 are utilized to secure the platform 101 to the toilet base 201. Moreover, the fasteners 110 comprise bolts and nuts, which provide ample clamping force needed to form a watertight seal at the interface of the gasket with both the first waste pipe 104 as well as the toilet base 201.

The platform 101 is configured to attach to an existing house waste pipe 300. It shall be noted that a bathroom floor 400 shall be modified to include a cavity 500 for full functioning of the invention 100. Moreover, the existing house waste pipe 300 is rigidly positioned inside of the cavity 500. The first waste pipe 104 is configured to slideably engage the existing house waste pipe 300. Referencing FIGS. 3-4, the first waste pipe 104 slides into a top portion 301 of the existing house waste pipe 300.

At least one seal member 120 is included with the invention 100, and is positioned in between the first waste pipe 104 and the top portion 301 of the existing house waste pipe 300. The seal member 120 is used to form a watertight connection between the first waste pipe 104 and the existing house waste pipe 300. It shall be noted that the first waste pipe 104 is able to slide up or down with respect to the existing house waste pipe 300 while maintaining a watertight connection with the top portion 301 of the existing house waste pipe 300 via the seal member 120.

Located inside of the cavity 500 is at least one lifting member 130, which is used to raise and lower the platform 101 as needed. The lifting member 130 is responsible for raising and lowering the platform 101 as well as the toilet 200 mounted thereon. The lifting member 130 is positioned inside of the cavity 500, and is not visible from the bathroom floor 400 as an access plate 140 is provided with the invention 100.

The lifting member 130 is constructed of a collar member 131 that attaches to the first waste pipe 104. The collar member 131 is affixed to the first waste pipe 104 from an outside surface of the first waste pipe 104. Moreover, the collar member 131 is attached to a linear actuator 132, which is responsible for moving the collar member 131 and platform 101 along the vertical axis 600. The linear actuator 132 may involve a hydraulic cylinder, a pneumatic cylinder, a scissor jack, or other mechanical or electromechanical jacking system that is able to raise and lower the weight required of the invention 100.

The lifting member 130 is controlled via a lift control member 135, which is also located in the cavity 500. The lift control member 135 may be in communication with a remote control 136 that is accessible inside of the bathroom that the toilet 200 and invention 100 are installed within.

The access plate 140 is essentially a component of the invention 100, which covers the cavity 500 from above while enabling the first waste pipe 104 to extend there through. The access plate 140 includes a stabilizer ring 141 that interfaces with the first waste pipe 104. The stabilizer ring 141 ensures a laminar movement of the first waste pipe 104 along a vertical axis 600.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A toilet-raising platform comprising:

a platform configured to attach to a toilet base of a toilet;

said platform is able to raise and lower the platform along a vertical platform;

said platform is slideably connected with an existing home waste pipe that is positioned underneath a bathroom floor;

wherein the platform is comprised of a gasket, a plate member, and a first waste pipe;

wherein the gasket is positioned in between a bottom toilet base surface of the toilet base, and a top plate member surface of the plate member;

wherein the plate member is rigidly affixed atop of the first waste pipe; wherein the first waste pipe and the plate member have an opening that aligns with a gasket hole of the gasket and a toilet base hole of the toilet base; wherein the opening, the gasket hole, and the toilet base hole align to form a watertight seal, which enables debris to exit the toilet, and down through the platform;

wherein a plurality of fasteners are utilized to secure the platform to the toilet base;

wherein the platform is configured to attach to an existing house waste pipe; wherein the bathroom floor includes a cavity; wherein the existing house waste pipe is rigidly positioned inside of the cavity; wherein the first waste pipe is configured to slideably engage the existing house waste pipe; wherein the first waste pipe slides into a top portion of the existing house waste pipe;

wherein at least one seal member is positioned in between the first waste pipe and the top portion of the existing house waste pipe; wherein the seal member is used to form a watertight connection between the first waste pipe and the existing house waste pipe; wherein the first waste pipe is able to slide up or down with respect to the existing house waste pipe while maintaining a watertight connection with the top portion of the existing house waste pipe via the seal member;

wherein at least one lifting member is located inside of the cavity; wherein the lifting member is used to raise and lower the platform as needed;

wherein the lifting member is responsible for raising and lowering the platform as well as the toilet mounted thereon; wherein the lifting member is positioned inside of the cavity, and is not visible from the bathroom floor as an access plate.

2. The toilet-raising platform according to claim 1 wherein the lifting member is constructed of a collar member that attaches to the first waste pipe; wherein the collar member is affixed to the first waste pipe from an outside surface of the first waste pipe.

3. The toilet-raising platform according to claim 2 wherein the collar member is attached to a linear actuator, which is responsible for moving the collar member and platform along the vertical axis.

4. The toilet-raising platform according to claim 3 wherein the lifting member is controlled via a lift control member.

5. The toilet-raising platform according to claim 4 wherein the lift control member is located in the cavity; wherein the lift control member is in communication with a remote control that is accessible with respect to the toilet.

6. The toilet-raising platform according to claim 5 wherein the access plate covers the cavity from above while enabling the first waste pipe to extend there through; wherein the access plate includes a stabilizer ring that interfaces with the first waste pipe; wherein the stabilizer ring ensures a laminar movement of the first waste pipe along a vertical axis.

* * * * *